US006951307B2

(12) United States Patent
Lin

(10) Patent No.: US 6,951,307 B2
(45) Date of Patent: Oct. 4, 2005

(54) TRACK ASSEMBLY FOR TRACK-GUIDED TOY VEHICLES

(75) Inventor: Ming-Hsiung Lin, Chungho (TW)

(73) Assignee: Touch-Rail Models Corp., Taipei (TW)

( * ) Notice: Subject to any disclaimer, the term of this patent is extended or adjusted under 35 U.S.C. 154(b) by 0 days.

(21) Appl. No.: 10/775,199

(22) Filed: Feb. 11, 2004

(65) Prior Publication Data

US 2005/0173551 A1 Aug. 11, 2005

(51) Int. Cl.[7] ..... E01B 23/00
(52) U.S. Cl. ..... 238/10 F
(58) Field of Search ..... 238/10 R, 10 A, 238/10 B, 10 C, 10 E, 10 F

(56) References Cited

U.S. PATENT DOCUMENTS 4,260,104 A * 4/1981 Schaffan ..... 238/10 E
5,139,198 A * 8/1992 Niehoff ..... 238/10 B

* cited by examiner

*Primary Examiner*—Mark T. Le
(74) *Attorney, Agent, or Firm*—Troxell Law Office, PLLC

(57) ABSTRACT

A track assembly for a track guided toy vehicle includes multiple track units connected to one another and each track unit having a supporting plate having multiple pairs of through holes defined through the supporting plate, two tracks slidably mounted on the supporting plate and a connecting plate fixture securely mounted beneath the supporting plate at two opposite ends of the supporting plate to receive therein a first connecting plate and a second connecting plate to be in engagement with the two tracks.

18 Claims, 6 Drawing Sheets

TRACK ASSEMBLY FOR TRACK-GUIDED TOY VEHICLES

BACKGROUND OF THE INVENTION

1. Field of the Invention

The present invention relates to a track assembly, and more particularly to a track assembly for track guided toy vehicles.

2. Description of Related Art

A track assembly provides a path for track guided vehicles so that the track guided vehicles are able to travel on the track assembly. With reference to FIG. 6, a conventional track assembly (5) is shown and has track units (50) interconnected with one another. Each track unit (50) includes two tracks (51) mounted on top of a base (52). A connecting plate (53) is securely connected to one of the tracks (51). The base (52) has a cutout (521) defined in a first end of the base (52) and a boss (522) formed on a second end of the base (52) and opposite to the cutout (521). Therefore, when two track units (50) are connected, the boss (522) from one track unit (50) is received in the cutout (521) of another track unit (50). As a consequence of the connection between the two track units (50), the connecting plate (53) of one track unit (50) is engaged with one of the two tracks (51) of another track unit (50). Thereafter, when electricity is provided to the track assembly (5), the track guided toy vehicle, i.e., a toy train, a slot racing car, is able to run on the track assembly (5). Due to the connecting plate (53), the overall appearance of the track unit (50) is ruined and the track unit (50) is very dangerous in that the protrusion of the connecting plate (53) may easily hurt the track guided vehicle player, especially children.

To overcome the shortcomings, the present invention tends to provide an improved track assembly to mitigate the aforementioned problems.

SUMMARY OF THE INVENTION

The primary objective of the present invention is to provide an improved track assembly which is safe to the player and easy for assembly.

Another objective of the present invention is to provide a connecting plate fixture under the track assembly such that after the connection between two track units, the engagement between the two connecting plate fixture is secured.

Other objects, advantages and novel features of the invention will become more apparent from the following detailed description when taken in conjunction with the accompanying drawings.

DETAILED DESCRIPTION OF THE PREFERRED EMBODIMENT

Figure 1:
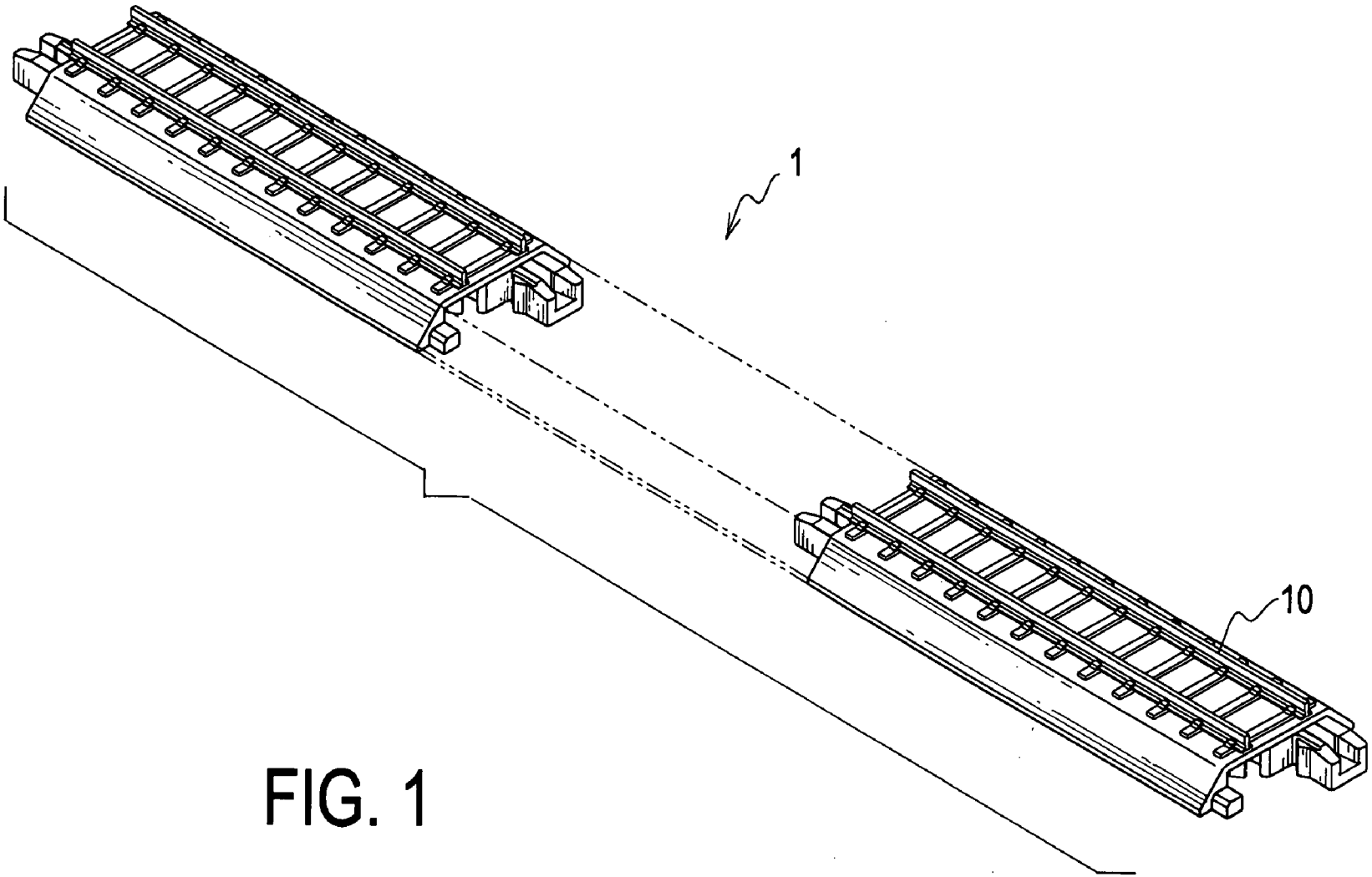
FIG. 1 is a perspective view of the track assembly of the present invention.
Figure 2:
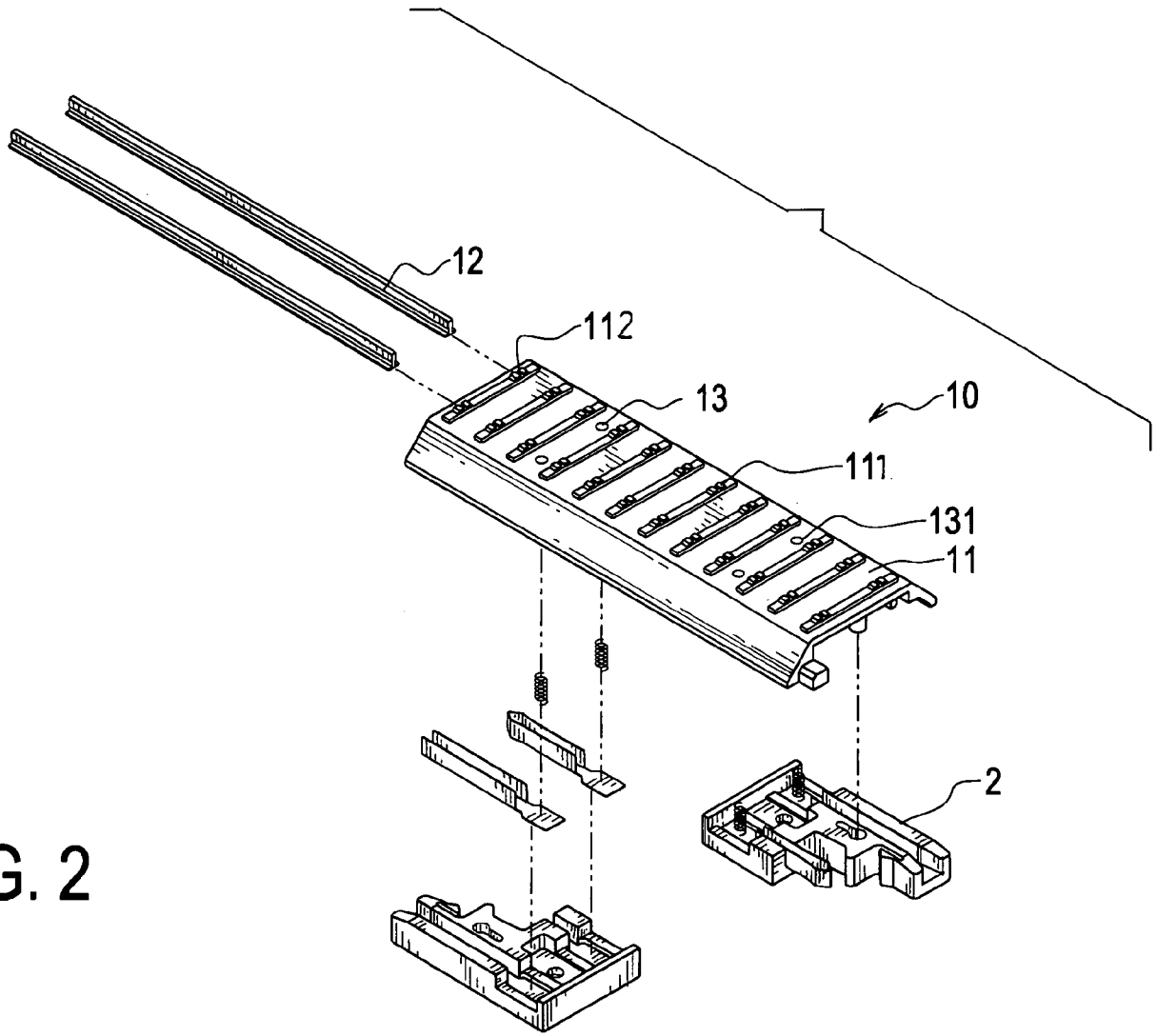
FIG. 2 is an exploded perspective view of one track unit of the track assembly of the present invention.

With reference to FIGS. 1 and 2, the track assembly (1) in accordance with the present invention has multiple track units (10). Each track unit (10) includes a supporting plate (11) with two T-shaped tracks (12) movably mounted on the supporting plate (11). The supporting plate (11) has multiple pairs of widthwise L-shaped retainers (111) formed on a top face of the supporting plate (11). Each retainer (111) defines therein a path (112) to correspond to the T-shaped track (12) such that each track (12) is able to be slidably received in the path (112) and thus retained by the retainers (111). Two pairs of widthwise through holes (13,13') are defined through the top face of the supporting plate (11).

Figure 3:
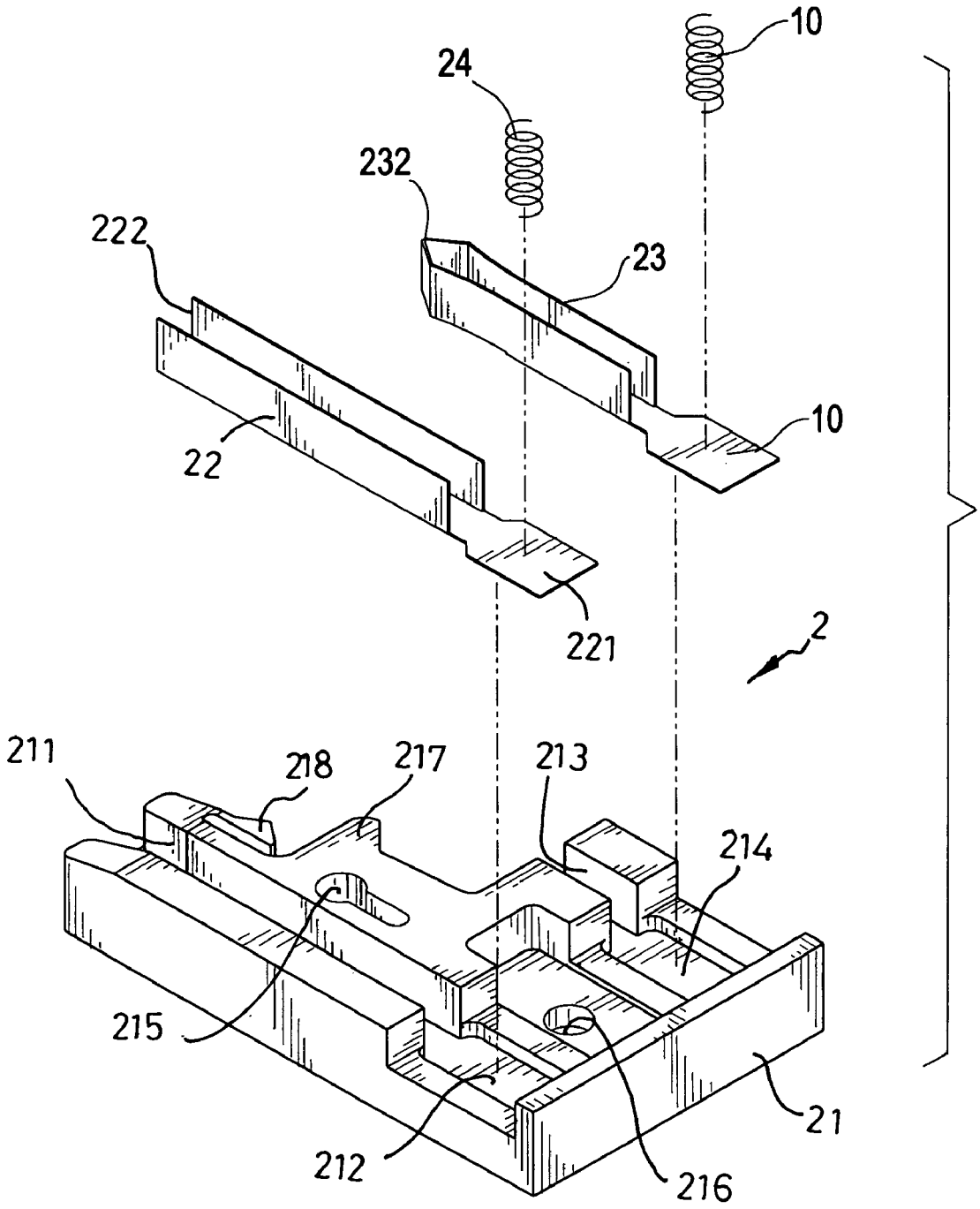
FIG. 3 is an enlarged exploded perspective view of a connecting plate fixture of the track unit of the track assembly of the present invention.

Two connecting plates fixture (2) are provided at two opposite ends under the supporting plate (11) and orientated to opposite directions relative to each other. With reference to FIG. 3, each connecting plate fixture (2) includes a connecting plate seat (21), a first connecting plate (22) securely mounted on the connecting plate seat (21) and having a first flat engaging end (221) and an open end (222) oppositely formed relative to the first flat engaging end (221) and a second connecting plate (23) securely mounted on the connecting plate seat (21) beside the first connecting plate (22) and having a second flat engaging end (231) and a pointed end (232) oppositely formed relative to the second flat engaging end (231). A first spring (24) and a second spring (25) are respectively provided to the first connecting plate (22) and the second connecting plate (23).

The connecting seat (21) is substantially L-shaped and thus has a vertical portion and a horizontal portion. The connecting plate seat (21) has a first channel (211) defined in a top face of the vertical portion of the connecting plate seat (21) to correspond to and receive therein the first connecting plate (22) and having a first space (212) defined in a joint between the vertical portion and the horizontal portion to be in communication with the first channel (211) to correspond to and receive therein the first flat engaging end (221) and a second channel (213) defined in top face of the horizontal portion of the connecting plate seat (21) beside the first channel (211) and having a second space (214) in communication with the second channel (213) to correspond to and receive therein the second flat engaging end (231). Furthermore, the connecting plate seat (21) has a first positioning hole (215), a second positioning hole (216), a first hook (217) formed on a side face of the vertical portion and a second hook (218) formed on the side face of the vertical portion of the vertical portion and on top of the first hook (217).

Figure 4:
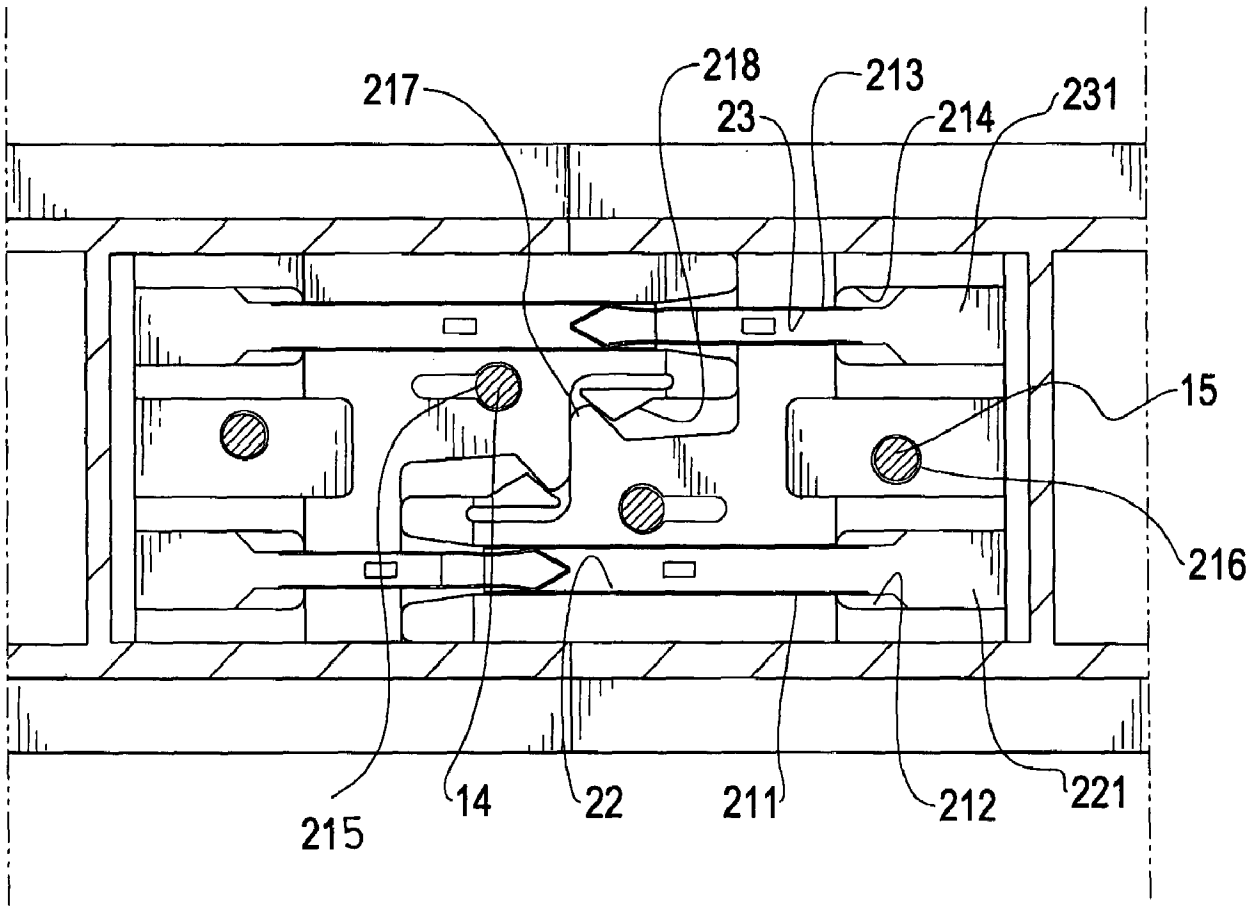
FIG. 4 is a top plan view showing the connection between two connecting plate fixtures from two track units.
Figure 5:
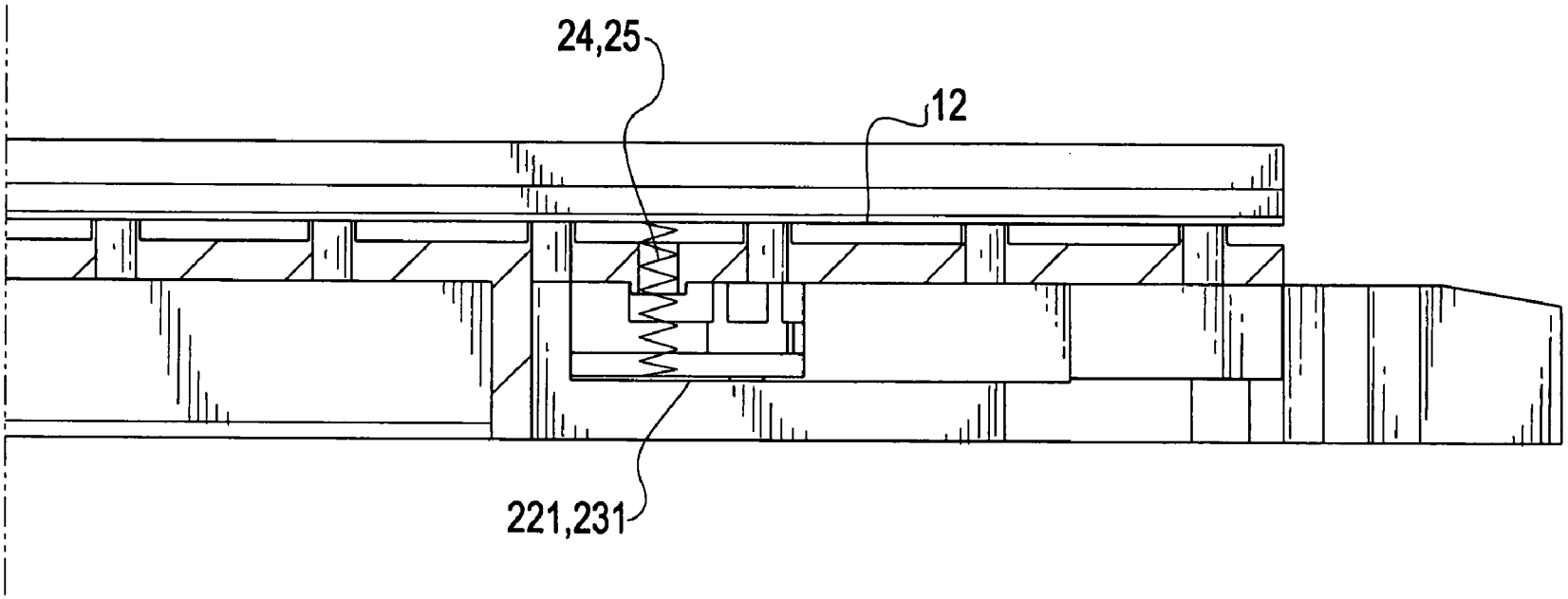
FIG. 5 is a cross sectional view showing the engagement between the connecting plate and the track.
Figure 6:
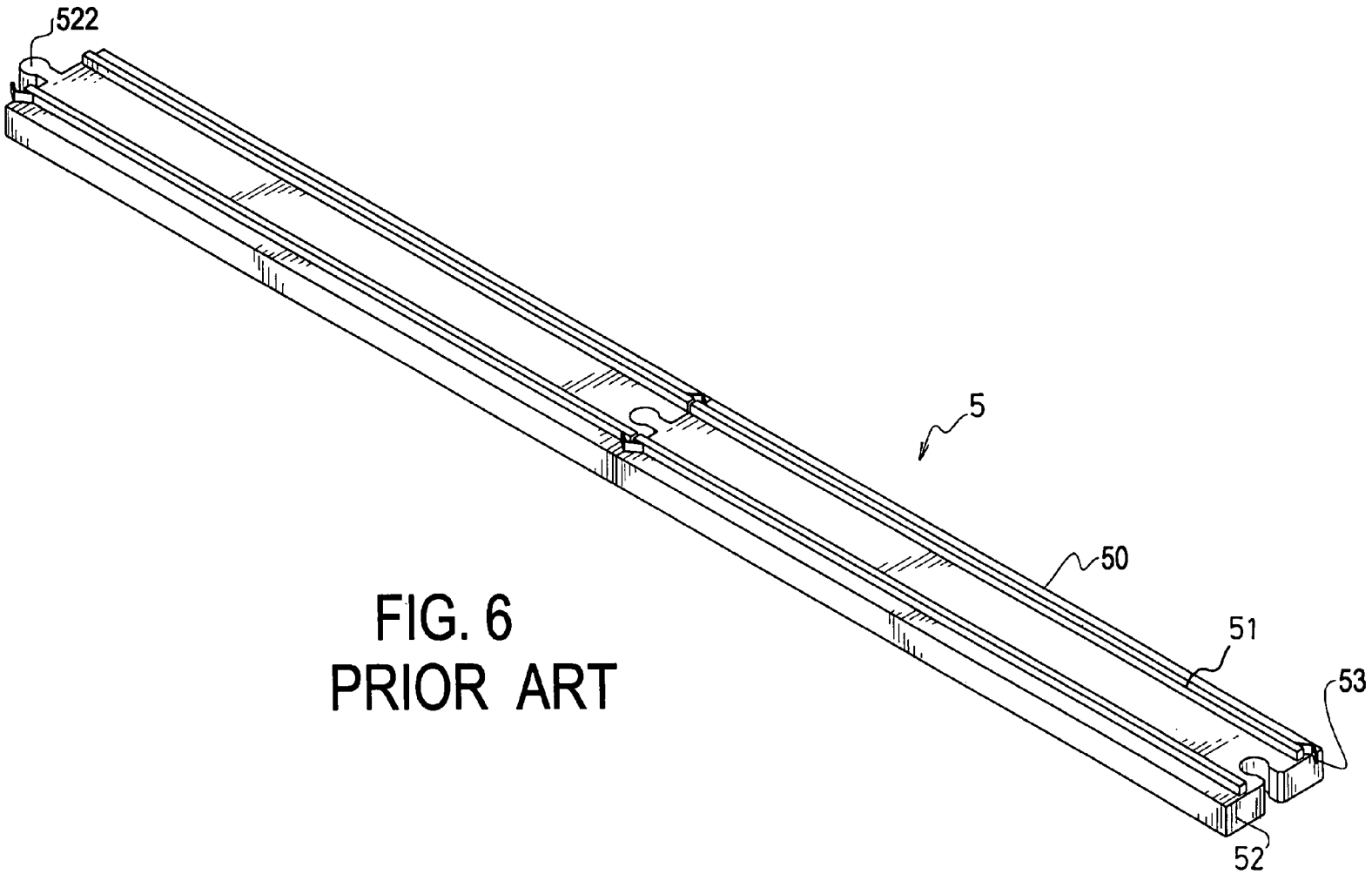
FIG. 6 PRIOR ART
FIG. 6 is a perspective view of a conventional track assembly.

With reference to FIG. 4, when the first connecting plate (22), the second connecting plate (23), the first spring (24), the second spring (25) and the connecting plate seat (21) are combined, it is noted that the first connecting plate (22) is received in the first channel (211) and the first flat engaging end (221) is received in the first space (212). The second connecting plate (23) is received in the second channel (213) to have the pointed end (232) extending out of the second channel (213) and the second flat engaging end (231) is received in the second space (214). A first positioning rod (14) extending from a bottom face of the supporting plate (11) extends into the first positioning hole (215) and a second positioning rod (15) extending from the bottom face of the supporting plate (11) extends into the second positioning hole (216) such that engagement between the supporting plate (11) and the connecting plate seat (21) is secured. Before the engagement between the supporting plate (11) and the two connecting plate seats (21) is finished at opposite ends of the supporting plate (11), with reference to FIG. 5, the first spring (24) is sandwiched between the first flat engaging end (221) and the second spring (25) is sandwiched between the second flat engaging end (231). First distal ends of both the first spring (24) and the second spring (25) are received in the through holes (13) to engage with a bottom side face of the tracks (12). Second distal ends of both the first spring (24) and the second spring (25) are engaged with the first flat engaging end (221) and the second flat engaging end (231) respectively.

Referring to FIG. 4, it is noted that when two track unit (10) are to be connected, the pointed end (232) and the open end (222) from one track unit (10) are inserted into the open end (222) and the pointed end (232) of the other track unit (10) respectively. Due the engagement between the first connecting plate (22) of one track unit (10) with the second connecting plate (23) of the other track unit (10) and the engagement between the second connecting plate (23) of one track unit (10) and the first connecting plate (22) of the other track unit (10), the two track units (10) are connected. In order to further enhance the connection between the two track units (10), the first hook (217) and the second hook (218) from one track unit (10) are respectively hooked to the second hook (218) and the first hook (217) of the other track unit (10) when two different track units (10) are combined.

Via the first and second springs (24,25), the first and second connecting plates (23,24) are connected to the two tracks (12). Furthermore, due to the engagement between two track units (10) via the first and second connecting plates (23,24) from one track unit (10) and the second and first connecting plates (24,23), an electrical connection between two track units (10) is finished. Because the connection between two track units (10) is beneath the track units (10), the overall appearance of the track unit (10) is tidy and accidental damage to the player is thus avoided.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A track assembly for track guided toy vehicle, the track assembly comprising:

multiple track units connected to one another and each track unit having:

a supporting plate having multiple pairs of through holes defined through the supporting plate;

two tracks slidably mounted on the supporting plate;

a connecting plate fixture having two connecting plate seats oppositely secured to a bottom face of the supporting plate and each connecting plate seat being configured to be an L shape to have a vertical portion and a horizontal portion, a first connecting plate securely received in the connecting plate seat and having a first flat engaging end and an open end, a second connecting plate received in the connecting plate seat and having a second flat engaging end and a pointed end, a first spring having a first end abutted to the first flat engaging end of the first connecting plate and a second end extending upward to engage with one of the two tracks and a second spring having a first end abutted to the second flat engaging end of the second connecting plate and a second end extending upward to engage with the other track of the two tracks such that electrical connection between the two tracks and the first and second connecting plates is finished and extending the pointed ends of the second connecting plates from two different track units into the open ends of the first connecting plates from the two different track units is able to complete connection between the two different track units.

2. The track assembly as claimed in claim 1, wherein the supporting plate has multiple pairs of retainers widthwise formed on the supporting plate and having a path defined between each pair of retainer to receive therein one of the tracks.

3. The track assembly as claimed in claim 2, wherein each track is T-shaped such that the T-shaped track is able to be received in the path in each of the retainers.

4. The track assembly as claimed in claim 1, wherein the connecting plate seat has a first channel defined on the vertical portion and in a top face of the connecting plate seat to correspond to and receive therein the first connecting plate, a first space in communication with the first channel and defined at a joint between the vertical portion and the horizontal portion to correspond to and receive therein the first flat engaging end of the first connecting plate, a second channel defined in the horizontal portion and the top face of the connecting plate seat to correspond to and receive therein the second connecting plate and a second space in communication with the second channel to correspond to and receive therein the second flat engaging end of the second connecting plate.

5. The track assembly as claimed in claim 1, wherein the supporting plate has two pairs of through holes defined through the supporting plate to allow the first and second springs to extend therethrough hole.

6. The track assembly as claimed in claim 4, wherein the supporting plate has two pairs of through holes defined through the supporting plate, the first spring has a first end abutted to the first flat engaging end of the first connecting plate and a second end extending through one through hole of a pair of the through holes to engage with one of the two tracks, the second spring has a first end abutted to the second flat engaging end of the second connecting plate and a second end extending through the other through hole of the pair of the through holes to engage with the other one of the two tracks.

7. The track assembly as claimed in claim 1, wherein the supporting plate has two pairs of positioning rods extending from the bottom face of the supporting plate to respectively correspond to two positioning holes in each of the two connecting plate seats to secure engagement of the two connecting plate seats to the supporting plate.

8. The track assembly as claimed in claim 4, wherein the supporting plate has two pairs of positioning rods extending from the bottom face of the supporting plate to respectively correspond to two positioning holes in each of the two connecting plate seats to secure engagement of the two connecting plate seats to the supporting plate.

9. The track assembly as claimed in claim 5, wherein the supporting plate has two pairs of positioning rods extending from the bottom face of the supporting plate to respectively correspond to two positioning holes in each of the two connecting plate seats to secure engagement of the two connecting plate seats to the supporting plate.

10. The track assembly as claimed in claim 6, wherein the supporting plate has two pairs of positioning rods extending from the bottom face of the supporting plate to respectively correspond to two positioning holes in each of the two connecting plate seats to secure engagement of the two connecting plate seats to the supporting plate.

11. The track assembly as claimed in claim 1, wherein each of the two connecting plate seats has a first hook and a second hook formed on a side face of the vertical portion and a second hook formed on the side face of the vertical portion and on top of the first hook such that the first hook from one track unit is able to engage with the second hook of a different track unit to secure engagement between two track units.

12. The track assembly as claimed in claim 4, wherein each of the two connecting plate seats has a first hook and a second hook formed on a side face of the vertical portion and a second hook formed on the side face of the vertical portion and on top of the first hook such that the first hook from one track unit is able to engage with the second hook of a different track unit to secure engagement between two track units.

13. The track assembly as claimed in claim 5, wherein each of the two connecting plate seats has a first hook and a second hook formed on a side face of the vertical portion and a second hook formed on the side face of the vertical portion and on top of the first hook such that the first hook from one track unit is able to engage with the second hook of a different track unit to secure engagement between two track units.

14. The track assembly as claimed in claim 6, wherein each of the two connecting plate seats has a first hook and a second hook formed on a side face of the vertical portion and a second hook formed on the side face of the vertical portion and on top of the first hook such that the first hook from one track unit is able to engage with the second hook of a different track unit to secure engagement between two track units.

15. The track assembly as claimed in claim 7, wherein each of the two connecting plate seats has a first hook and a second hook formed on a side face of the vertical portion and a second hook formed on the side face of the vertical portion and on top of the first hook such that the first hook from one track unit is able to engage with the second hook of a different track unit to secure engagement between two track units.

16. The track assembly as claimed in claim 8, wherein each of the two connecting plate seats has a first hook and a second hook formed on a side face of the vertical portion and a second hook formed on the side face of the vertical portion and on top of the first hook such that the first hook from one track unit is able to engage with the second hook of a different track unit to secure engagement between two track units.

17. The track assembly as claimed in claim 9, wherein each of the two connecting plate seats has a first hook and a second hook formed on a side face of the vertical portion and a second hook formed on the side face of the vertical portion and on top of the first hook such that the first hook from one track unit is able to engage with the second hook of a different track unit to secure engagement between two track units.

18. The track assembly as claimed in claim 10, wherein each of the two connecting plate seats has a first hook and a second hook formed on a side face of the vertical portion and a second hook formed on the side face of the vertical portion and on top of the first hook such that the first hook from one track unit is able to engage with the second hook of a different track unit to secure engagement between two track units.

* * * * *